United States Patent [19]

Hasumi et al.

[11] Patent Number: 4,470,396

[45] Date of Patent: Sep. 11, 1984

[54] INTERNAL COMBUSTION ENGINE CONTROL SYSTEM WITH MEANS FOR RESHAPING OF COMMAND FROM DRIVER'S FOOT PEDAL

[75] Inventors: Kazuhisa Hasumi, Odawara; Takashi Ishida, Kanagawaken, both of Japan

[73] Assignee: Mikuni Kogyo Kabushiki Kaisha, Tokyo, Japan

[21] Appl. No.: 446,385

[22] Filed: Dec. 2, 1982

[51] Int. Cl.[3] ..... F02B 3/00; F02D 11/10

[52] U.S. Cl. ..... 123/488; 123/478; 123/399

[58] Field of Search ..... 123/494, 478, 472, 399, 123/445, 361, 491, 488

[56] References Cited

U.S. PATENT DOCUMENTS

| | | | |
|---|---|---|---|
| 3,750,632 | 8/1973 | Sechnall | 123/488 |
| 3,983,848 | 10/1976 | Handtmann | 123/494 |
| 4,112,885 | 9/1978 | Iwata | 123/399 |
| 4,126,107 | 11/1978 | Harada | 123/492 |
| 4,138,979 | 2/1979 | Taplin | 123/445 |
| 4,143,622 | 3/1979 | Klotzner | 123/492 |
| 4,168,679 | 9/1979 | Ikeura | 123/399 |

*Primary Examiner*—Ronald B. Cox

*Attorney, Agent, or Firm*—Owen, Wickersham & Erickson

[57] ABSTRACT

An electronic control fuel injection system for a spark ignition internal combustion engine is described wherein air flow rate is controlled as a function of fuel flow rate by transmitting an operator's depression stroke of an accelerator pedal to a fuel selecting mechanism, applying a signal representative of the selected fuel flow rate to a computer which determines the optimum air flow rate, thereby controlling the opening of a throttle valve to provide it. Within the computer, the relationship of the accelerator pedal movement to actual fuel flow command is varied in a predetermined manner to provide a desired engine response characteristic. Thus, the drive feeling for a vehicle can be varied within a range from normal to either a faster or more conservative engine reaction.

7 Claims, 2 Drawing Figures

INTERNAL COMBUSTION ENGINE CONTROL SYSTEM WITH MEANS FOR RESHAPING OF COMMAND FROM DRIVER'S FOOT PEDAL

BACKGROUND OF THE INVENTION

This invention relates to an electronic control fuel injection system for a spark ignition internal combustion engine of the type wherein fuel flow rate is operator initiated and air flow rate is controlled as a function of fuel flow rate and, more particularly to such a system that provides a preselected engine response characteristic for the initiated fuel flow rate.

In copending application Ser. No. 228,973, filed Jan. 27, 1981 now abandoned and assigned to the assignee of this application, an electronic control fuel injection system for a spark ignition internal combustion engine is disclosed wherein air flow rate is controlled as a function of fuel flow rate. The fuel flow rate is transmitted by the operator's depression stroke of an accelerator pedal to a fuel selecting mechanism which determines the fuel flow rate and supplies a signal representative of the selected fuel rate to a computer together with various correction information. Using the selected fuel flow input, the computer calculates an optimum air flow rate and controls a throttle valve in the engine air manifold to provide the optimum air flow. For various engines, or engine/vehicle combinations, the normal or actual engine response characteristic relative to accelerator pedal movement is not desirable or satisfactory. For example, some vehicle operators may wish to have a quicker or more powerful engine response such as might be provided in a relatively light or more powerful vehicle, while others may wish to have a slower response that would provide a higher degree of fuel economy.

Heretofore, in prior engine control systems, some attempts were made to vary the power response characteristics relative to accelerator pedal movement by use of relatively complicated mechanical linkages and/or other mechanisms between the accelerator pedal and the fuel flow control such as the fuel injectors or carburetor. However, such mechanical interconnections were not satisfactory for a range of driving conditions and also were often excessively complex and thus, unreliable and expensive.

SUMMARY OF THE INVENTION

A general object of the present invention is to provide an electronically controlled fuel injection system for a spark ignition internal combustion engine which produces engine response characteristics in accordance with a predetermined controlled relationship of accelerator pedal position and actual fuel flow and one which overcomes the disadvantages and problems of prior systems that control the air flow rate to an engine as a function of fuel flow rate.

Another object of the present invention is to provide an electronically controlled fuel injection system for internal combustion engines wherein optimum air flow is calculated and controlled by a computer as a function of the fuel flow rate established by an accelerator pedal and wherein the actual fuel flow rate is controlled on the basis of a predetermined relationship with the pedal position.

Still another object of the invention is to provide for controlled nonlinear response characteristics of the fuel flow system relative to the mechanical movement of the accelerator pedal, along with optimum air fuel ratios.

In accordance with the invention, an electronic control system for an internal combustion engine is provided wherein the position of the accelerator pedal is transmitted in the form of fuel command data signals to a computer. Within the computer is a first section that is programmed to establish a predetermined relationship between the actual fuel rate input signal received from the accelerator pedal encoder and an arbitrary fuel rate signal in accordance with a preshaped power curve with desired characteristics. The arbitrary or modified fuel rate signal from the first computer section is then furnished to another computer section which calculates an output signal to a throttle control to provide the optimum air flow rate in an engine air inlet. The second computer section uses other engine inputs to calculate the air necessary to provide the ideal air/fuel rates for the engine. The throttle control may comprise an appropriate servo mechanism connected to the throttle valve to move it within the engine air manifold. Thus, the engine will provide a power output according to a preselected curve based on the accelerator pedal position but shaped in a manner to provide the desired response characteristic.

Other objects, advantages and features of the invention will become apparent from the following description presented in conjunction with the accompanying drawing.

DETAILED DESCRIPTION OF PREFERRED EMBODIMENTS

Figure 1:
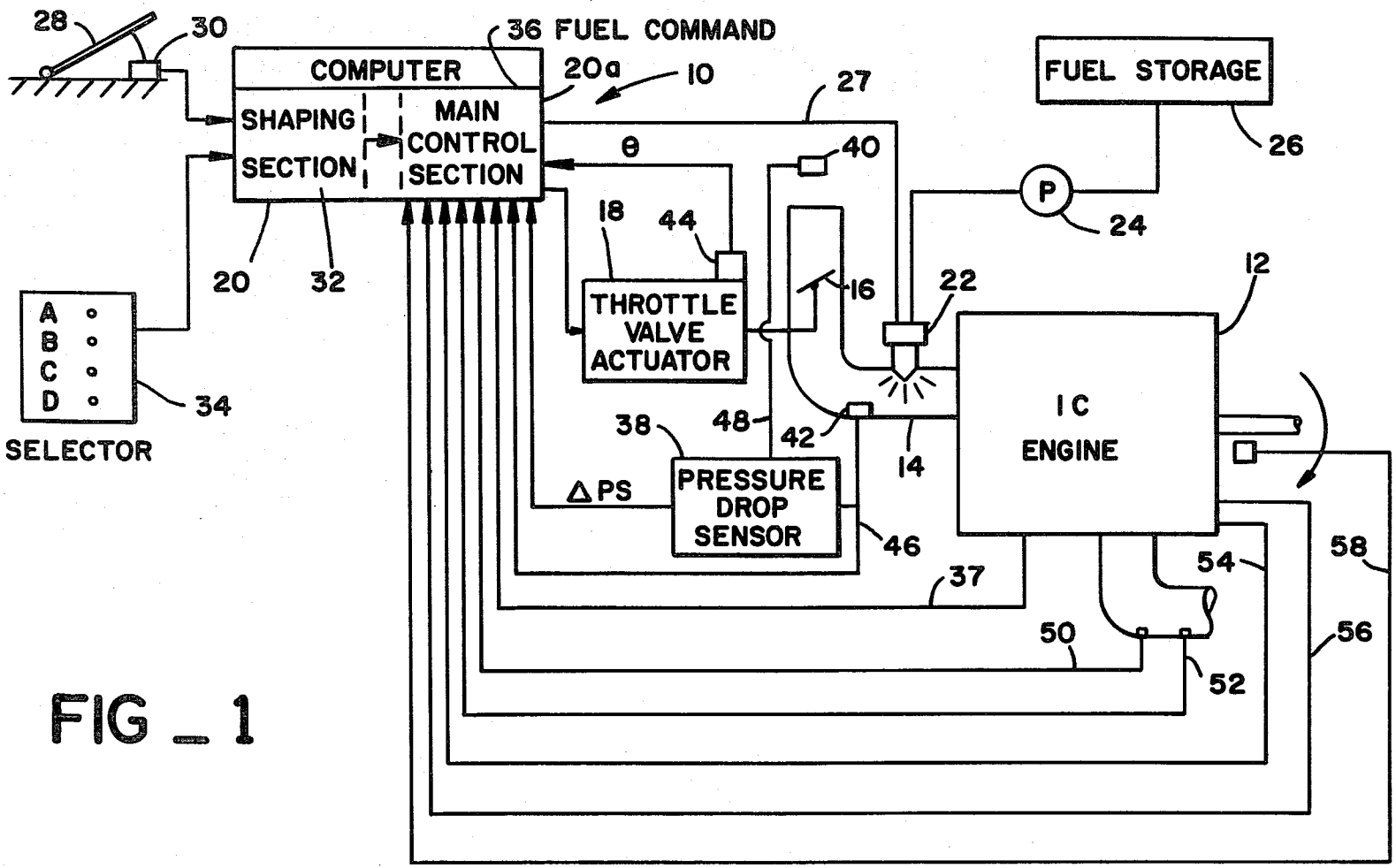
FIG. 1 is a block diagram of an engine control system embodying principles of the present invention.

With reference to the drawing, FIG. 1 shows diagrammatically a control system 10 for an internal combustion engine 12 according to the invention. In the embodiment shown, the control system is the fuel priority engine air control (EAC) type, but the invention disclosed herein could be applied to any type of electronically controlled or "drive by wire" engine control system.

As shown, air is supplied to the engine through an intake manifold 14 in an amount determined by the position of a throttle plate 16 which is rotatably mounted within the manifold. The angular position of the throttle plate is controlled by a throttle actuator 18, such as a stepping motor. Commands to the actuator 18 for positioning the throttle plate originate from an engine control unit 20 which is essentially a preprogramed digital computer. Fuel for the engine is supplied by one or more injectors, indicated by the numeral 22, which are attached to the air manifold in such a manner to cause air and fuel to be mixed together before entering each cylinder of the engine. Fuel to the injector(s) is supplied via a pump 24 from a fuel tank 26. Each injector 22 receives a command signal from the engine control unit 20 via lead 27 which modulates the injector 22 and causes it to dispense the proper amount of fuel into the air stream. The precise amount of fuel supplied for each cylinder firing is determined by a square wave pulse signal produced from the engine control unit 20 and sent via the lead 27.

In the EAC type system shown, the fuel flow rate desired by the operator is provided by actuation of an accelerator foot pedal 28. The precise position of the pedal is determined by an encoder 30 or some other form of position indicator which sends appropriate pedal position signals to the engine control unit. Within the control unit 20 is a curve shaping section 32 which alters the pedal encoder input signal in accordance with a predetermined power curve shaping function. The particular shaping function may be selected from one or more available curve functions which may be stored in the computer memory and each one of which provides a desired characteristic or "feel" to the operation of the vehicle. An external selector 34 may be provided which is connected to the computer to enable the operator to select the driving response curve of his choice.

Figure 2:
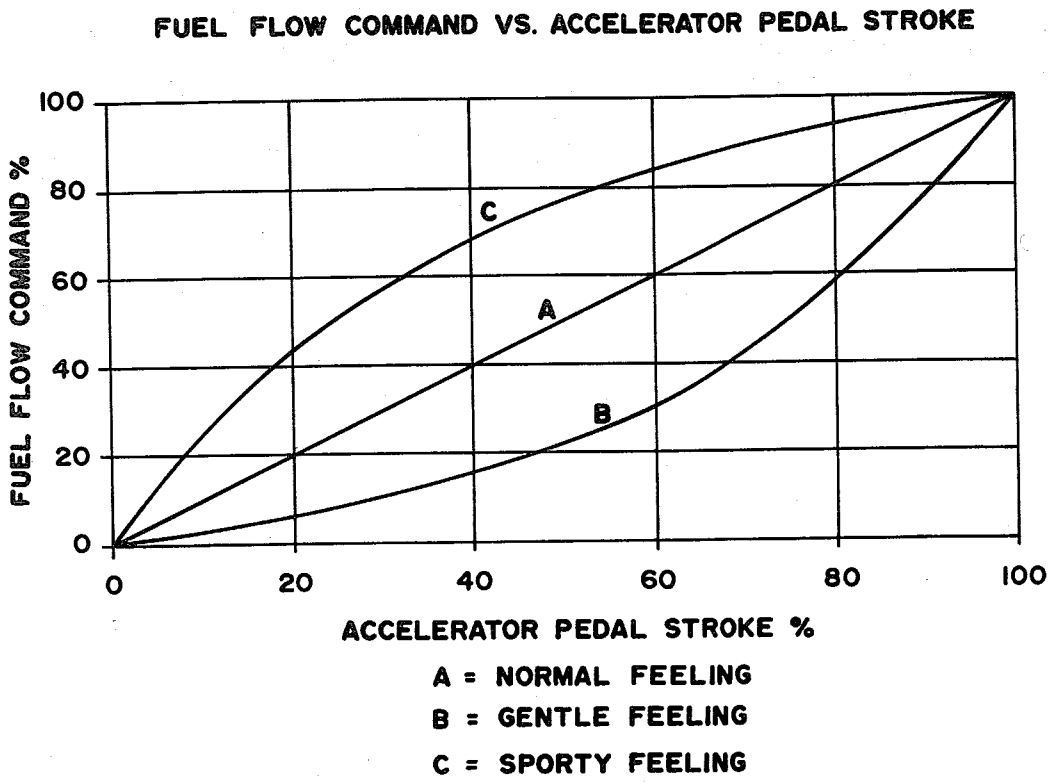
FIG. 2 is a diagram illustrating the relationship of fuel flow command and accelerator pedal position with respect to various preselected vehicle response characteristics provided by the invention.

Typical reshaped driving curves that may be provided are shown in FIG. 2. For example, a curve A may be linear ($y=mx$) while a curve C would increase the fuel demand signal from that indicated by the actual pedal position, thereby providing an engine response similar to a more powerful vehicle in the acceleration mode. One such curve C is of the type $y=m\sqrt{x}$. An opposite effect would be obtained by the curve B which would tend to reduce the actual fuel demand and provide for more fuel economy in the acceleration mode, as by an equation $y=mx^2$. It is not necessary that the shaping curves, such as examples B and C, be in accordance with an explicit function. They could also be specified as selected data points forming a one dimensional map which can be interpolated by the computer to achieve the desired reshaping function.

When the fuel command signal has been modified by the shaping section of the computer, it is supplied to a main EAC control section 36 of the computer which calculates the initial air flow rate is performed in the digital computer 20, using a table look-up function from a memory in which various air flow rate values are stored in accordance with various input fuel commands. The main EAC control section **20*a* of the control unit computer may also use other variable inputs, including intake manifold pressure 42 via lead 46, atmospheric pressure 40 via lead 48, exhaust temperature via lead 50, exhaust oxygen content via lead 52, engine oil pressure via lead 54, engine temperature via lead 56, or engine speed via lead 58, along with internally stored information. These variable inputs may be utilized by software in the control section 20*a* to calculate the desired fuel flow in accordance with known air/fuel ratio criteria and formulae under different conditions. Typical locations for these sensors are indicated on FIG. 1**.

After the initial air flow rate is calculated, it is corrected for engine temperature in accordance with the engine temperature detection signal applied from a suitable sensor via a lead 37, and this correction creates a slight offset in the air flow rate initially calculated. After correction of the air flow rate signal, it is combined subtractively with an actual air flow rate signal which is calculated by the computer from a $\Delta$ PS signal received from a pressure differential sensor 38 that monitors upstream and downstream pressure input 40 and 42 from within the air manifold 14 at opposite sides of the throttle plate 16. The throttle opening position signal $\Theta$ may be provided from a sensor 44 associated with the throttle actuator 18.

Additional refinements in the calculated actual air flow can be made when ambient temperature and ambient pressure are inputted into the calculation by suitable sensors (not shown). The difference between the desired air flow rate $A_d$, calculated by the computer and the actual air flow rate $A_a$, which is also calculated by the computer, is used as an output signal to drive the throttle servo 18 to a desired position. As with the initial air flow rate calculation, both the correction for engine temperature and calculation of actual air flow rate can likewise be accomplished using a stored scheduling table in which a predetermined output value is indicated for predetermined combinations of input signals for the various parameters.

Thus, when engine power is plotted with time, the normal response curve A can be shaped by a computer program to provide different variations of feeling or engine response. As seen, the pedal-fuel command curve C makes the engine power response faster as compared to the normal pedal-fuel command curve A. This imparts a sports car like feeling to the vehicle. Use of the power curve B, on the other hand, will provide a slower, more gentle response for a more conservative feeling. In each case, the precise shape of curve B or C, or any other desired response curve, can be attained by appropriate adjustment of the computer program.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. An electronic control fuel injection system for a spark ignition internal combustion engine having a throttle valve for preferentially determining fuel flow rate and subordinately determining air flow rate to the engine in response to the fuel flow rate and the engine operating state comprising:

an accelerator pedal having a stroke from an idle position to a maximum position;

fuel command means driven by said pedal for producing a fuel command signal varying in accordance with a non-linear mathematical function of the distance of said pedal from its idle position and derivatives or differences of said distance with respect to time;

reshaping means for selecting a particular said non-linear function;

fuel metering means for discharging the fuel in accordance with the command from said fuel command means;

at least one fuel injector for injecting said fuel discharge amount into said engine;

intake air flow sensing means for detecting the amount of intake air to said engine;

computing means for selectively receiving output signals from said fuel metering means indicating said fuel discharge amount and output signals from said intake air flow sensing means indicating actual air flow, and calculating an optimum air supply amount, and throttle valve servo means for determining the openng of said throttle valve according to the output from said computing means to provide said optimum air supply amount to said engine.

2. An electronic control fuel injection system for a spark ignition internal combustion engine having a throttle valve for preferentially determining fuel flow rate and subordinately determining air flow rate to the engine in response to the fuel flow rate and the engine operating state, comprising:

an accelerator pedal having a stroke from an idle position to a maximum position;

encoder means for generating an accelerator position signal;

fuel command means driven by said encoder means for producing a fuel command signal varying in accordance with a particular non-linear mathematical function of the distance of said pedal from its idle position;

at least one fuel injector for injecting said fuel discharge amount into said engine and having fuel metering means for discharging the fuel in accordance with said fuel command signal;

calculator means for initially calculating a raw, uncorrected desired air flow rate $A_r$ corresponding to optimum air flow for each fuel flow value as delivered by said fuel metering means, and for later calculating corrected values;

temperature detecting means for detecting engine temperature and transmitting its value to said calculation means for calculating a corrected desired air flow rate $A_d$;

air flow sensing means for detecting the actual amount of intake air $A_a$ being supplied to said engine at each instant;

subtracting means for subtracting continuously the value $A_a$ from $A_d$ and generating a difference signal therefrom; and throttle valve servo means driven by said difference signal for varying the opening of said throttle valve to move the difference toward zero to provide said optimum air supply amount to said engine.

3. An electronic control fuel injection system for a spark ignition internal combustion engine having a throttle valve for preferentially determining fuel flow rate and subordinately determining air flow rate to the engine in response to the fuel flow rate and the engine operating state, comprising:

an accelerator pedal having a stroke from an idle position to a maximum position, encoder means for generating an accelerator position signal, fuel command means driven by said encoder means for producing a fuel command signal varying in accordance with a particular mathematical function of the distance of said pedal from its idle position, at least one fuel injector for injecting said fuel discharge amount into said engine and having fuel metering means for discharging the fuel in accordance with said fuel command signal;

calculator means for initially calculating a raw, uncorrected desired air flow rate $A_r$ corresponding to optimum air flow for each fuel flow value as delivered by said fuel metering means, and for later calculating corrected values, temperature detecting means for detecting engine temperature and transmitting its value to said calculation means for calculating a corrected desired air flow rate $A_d$, a second temperature sensing means for sensing ambient atmospheric temperature and sending the second value to said calculator means to refine the value $A_d$, pressure sensing means for sensing ambient atmospheric pressure and sending the second value to said calculator means to refine further the value $A_d$, air flow sensing means for detecting the actual amount of intake air $A_a$ being supplied to said engine at each instant, subtracting means for for subtracting continuously the value $A_a$ from $A_d$ and generating a difference signal therefrom, and throttle valve servo means driven by said difference signal for varying the opening of said throttle valve to move the difference toward zero to provide said optimum air supply amount to said engine.

4. The system of claim 1 wherein said reshaping means selects said function from the powers $\frac{1}{2}$, and 2.

5. The system of claim 1 wherein said fuel command means includes as part thereof a portion of said computing means.

6. The system of claim 3 having reshaping means for changing one said particular mathematical funtion to a different particular mathematical function.

7. The system of claim 2 having reshaping means for changing one said particular mathematical funtion to a different particular mathematic funtion.

* * * * *